US006171407B1

(12) United States Patent
Rackoski et al.

(10) Patent No.: US 6,171,407 B1
(45) Date of Patent: Jan. 9, 2001

(54) VENTILATION FIXTURE AND METHOD OF USING SAME

(75) Inventors: David J. Rackoski, Chandler; Anthony M. Jones, Phoenix, both of AZ (US)

(73) Assignee: Motorola, Inc., Schaumburg, IL (US)

( * ) Notice: Under 35 U.S.C. 154(b), the term of this patent shall be extended for 0 days.

(21) Appl. No.: 09/415,075

(22) Filed: Oct. 12, 1999

(51) Int. Cl.[7] ..... B08B 13/00
(52) U.S. Cl. ..... 134/21; 454/49
(58) Field of Search ..... 454/49, 63; 134/1.1, 134/1.2, 21

(56) References Cited

U.S. PATENT DOCUMENTS

| | | | | |
|---|---|---|---|---|
| 3,631,791 | * | 1/1972 | Harris et al. | 454/49 |
| 4,071,338 | | 1/1978 | Hutter, III et al. | 55/385 |
| 4,345,615 | * | 8/1982 | De Cicco et al. . | |
| 4,898,089 | * | 2/1990 | Roos | 454/49 |
| 5,025,280 | * | 6/1991 | Lamb et al. . | |
| 5,244,433 | | 9/1993 | Utterback | 454/49 |
| 5,336,128 | | 8/1994 | Birdsong | 454/56 |
| 5,452,481 | | 9/1995 | Meyer | 4/213 |
| 5,711,289 | * | 1/1998 | Gabryszewski | 454/49 X |
| 5,850,638 | | 12/1998 | Her | 4/213 |
| 5,900,047 | | 5/1999 | Rodriguez et al. | 96/243 |

FOREIGN PATENT DOCUMENTS

| | | | | |
|---|---|---|---|---|
| 0 481 535 | * | 4/1992 | (EP) | 454/49 |
| 525842 | * | 8/1976 | (SU) | 454/49 |

* cited by examiner

*Primary Examiner*—Harold Joyce
(74) *Attorney, Agent, or Firm*—Anthony M. Martinez

(57) ABSTRACT

An apparatus and method are provided for removing gases produced during off-service cleaning of a processing chamber which operates under vacuum in a wafer fabrication tool. The apparatus includes a ventilation fixture providing a manifold having an internal cavity in fluid communication with a source of vacuum and at least one intake aperture, and a quick disconnect fitting connected to the source of vacuum and in fluid communication with the internal cavity. The manifold is portable and located adjacent to the processing chamber during cleaning.

17 Claims, 5 Drawing Sheets

VENTILATION FIXTURE AND METHOD OF USING SAME

FIELD OF THE INVENTION

The present invention relates, in general, to ventilation fixtures and, more particularly, to a ventilation fixture and method of employing same to remove gases produced during off-service cleaning of a processing chamber which operates under vacuum in a wafer fabrication tool.

BACKGROUND OF THE INVENTION

Plasma etch tools are one of the more common machines used throughout the wafer fabrication industry. Plasma etch tools are programmed to precisely remove material in a desired area of a wafer. The physical components of a plasma etch tool include a processing chamber, a vacuum pumping system, gas sources, and a radio frequency (RF) power supply.

The plasma etching process occurs in the following generic sequence. Wafers first enter the processing chamber via robotic transfer. The pumping system is activated and proceeds to pull the processing chamber into a desired state of vacuum. Gases are then introduced into the chamber and allowed to mix. A power supply is then activated which creates an RF field using electrodes within the processing chamber. The energized gas mixture then converts to a "plasma" or ionized form and reacts with the wafer surface to begin the etching process.

One result of this dry etch process is the formation of gaseous byproduct compounds that are exhausted from the plasma etch tool processing chamber through the vacuum pumping system. Although most of the compounds exit the processing chamber via the vacuum pumping system, some byproducts also adhere to the walls of the processing chamber. These byproducts eventually result in particle contamination of wafers being processed in the chamber. When in-situ statistical process control monitoring systems detect a process shift due to particle contamination, the plasma etch tool is taken out of service and the vacuum system is vented to atmosphere.

At this time, etch technicians perform a manual chamber clean. Before opening the processing chamber, a cyclic nitrogen purge process is usually applied in the vacuum state. Manual cleaning of etch processing chambers typically uses an industry standard 3% solution of isopropyl alcohol (IPA) and deionized water (DI) to physically wipe down and clean the particle laden chamber walls and ceramics. At the time of opening a purged processing chamber and especially as the IPA/DI cleaning solution comes into contact with the chamber residues, particularly odorous byproducts are formed and emit from the chamber components.

Since wafer fabrication occurs in cleanroom environments, a large amount of air is continuously moved through high efficiency particulate attenuation (HEPA) filters in order to limit particle contamination of the wafers being processed. Because of the large amount of air circulating, odorous byproduct emissions produced during manual plasma etch chamber cleans are frequently transferred throughout the fabrication area. Therefore, not only are etch technicians working on the chamber clean effected by the odors, but so are the operators, engineers and other support people who are working in the immediate and surrounding areas.

Several approaches have been used in the past to address the odor problem that occurs during plasma etch tool chamber cleans.

In one approach, no extra precautions are employed, and the odorous off-gassing is allowed to circulate per normal cleanroom air flow. As a result, technicians involved with a chamber clean minimize the time they are working over the chamber opening, thereby slowing the cleaning process. Operations and other factory personnel working in the immediate area either move to an area where odors are not detectable, or leave the processing area altogether until the fab air exchanges clear the odors. This procedure can contribute to lost production time due to operators being forced to leave their equipment or to factory evacuations if the odors become too intense.

A second approach to handle odorous off-gassing involves running a trunk line from the house acid exhaust system. When a plasma etch chamber clean occurs, the trunk line is placed near the chamber opening or hung over the chamber opening. Neither case is effective in capturing the byproduct off-gassing from the chamber opening. Significant odors are still prevalent.

Another approach used in the past is to exhaust the processing chamber through the vacuum duct of the etch tool. Such a task requires removing components of the vacuum pump system downstream of the plasma etch processing chamber and connecting a flexible acid exhaust duct line. This method typically results in additional equipment downtime required to disassemble tool components, as well as incomplete capture of the odors being created during the chamber cleaning process.

Accordingly, it would be advantageous to have a ventilation fixture and a method of employing same which overcome these and other deficiencies of the prior art.

DETAILED DESCRIPTION OF THE DRAWINGS

Generally, the present invention provides a portable ventilation fixture that removes odorous constituents and byproducts from the processing chamber of a plasma etch tool produced during cleaning of the chamber. In addition, the present invention provides a ventilation fixture for use with a variety of plasma etch tools, and more generally, with tools operated under vacuum in a processing chamber. Further, the present invention provides a ventilation fixture, which permits a technician's unobstructed view and access into a tool's processing chamber for cleaning.

Figure 1:
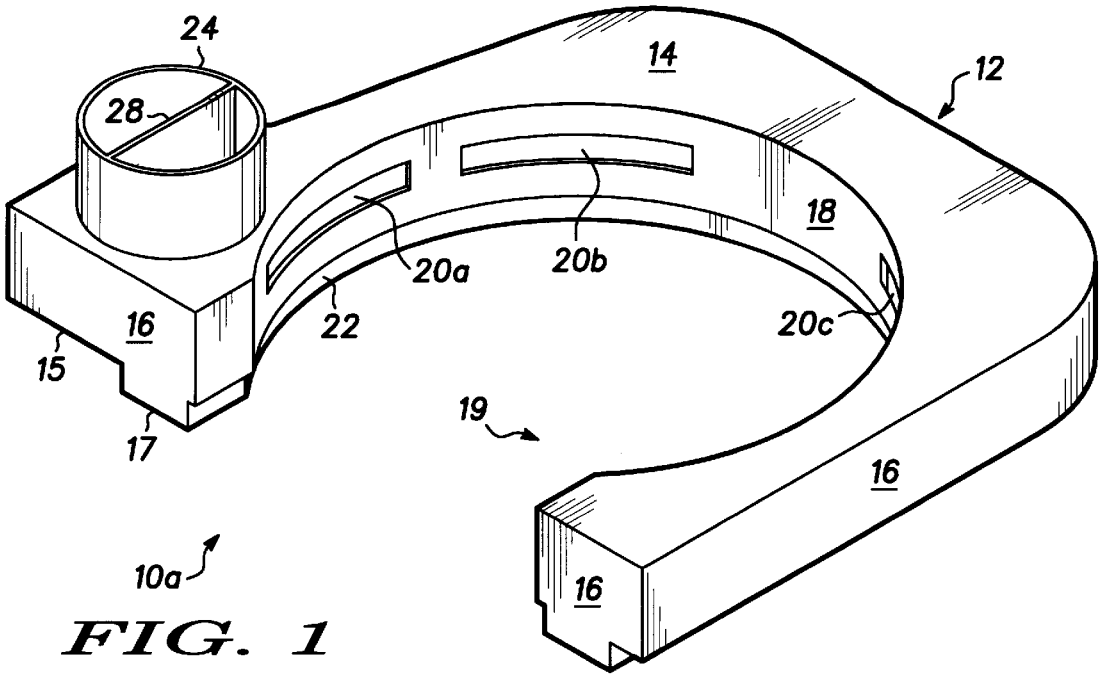
FIG. 1 is an upper perspective view of one embodiment of a ventilation fixture in accordance with a first embodiment of the present invention.
Figure 2:
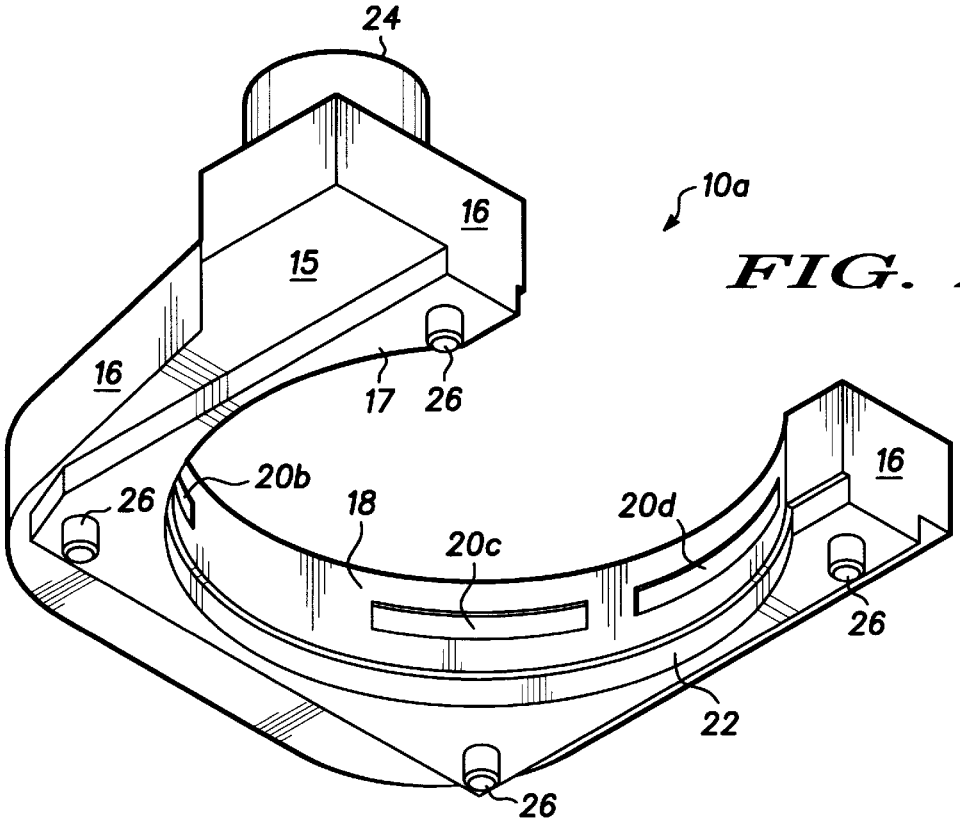
FIG. 2 is a lower perspective view of the ventilation fixture of FIG. 1.
Figure 3:
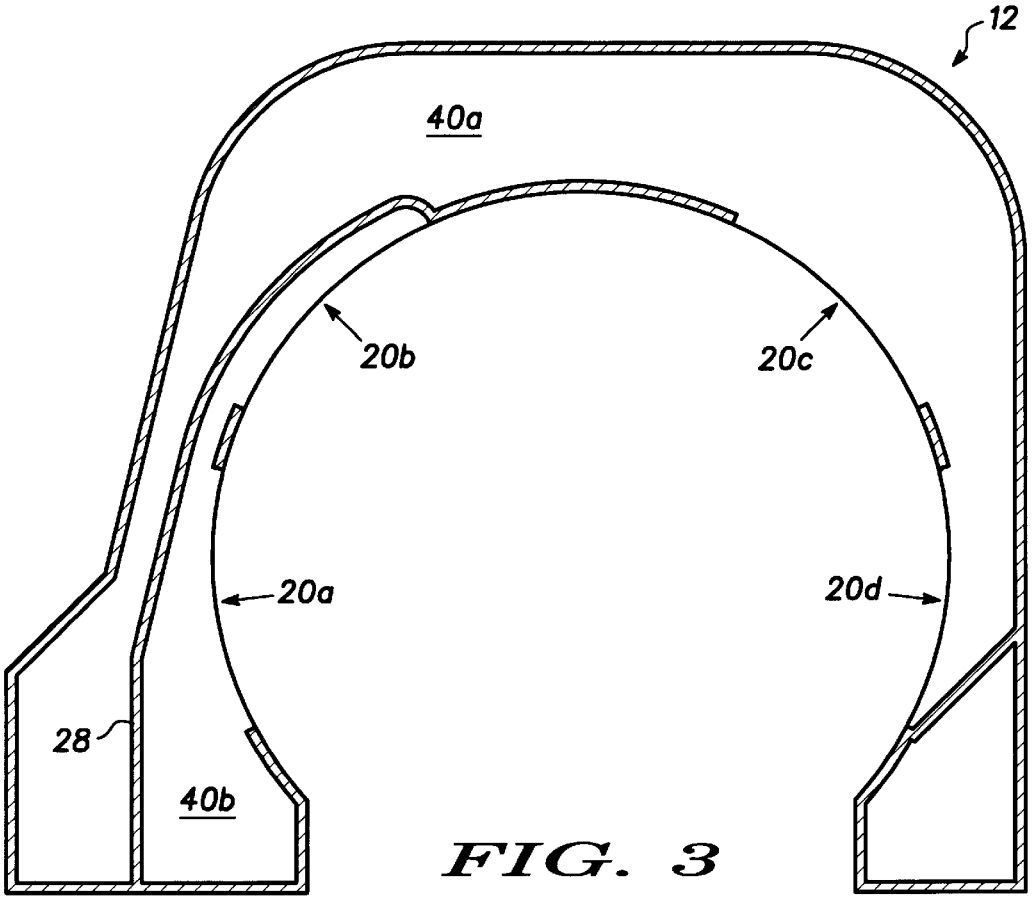
FIG. 3 is a horizontal cross-sectional view taken through the ventilation fixture of FIG. 1.
Figure 4:
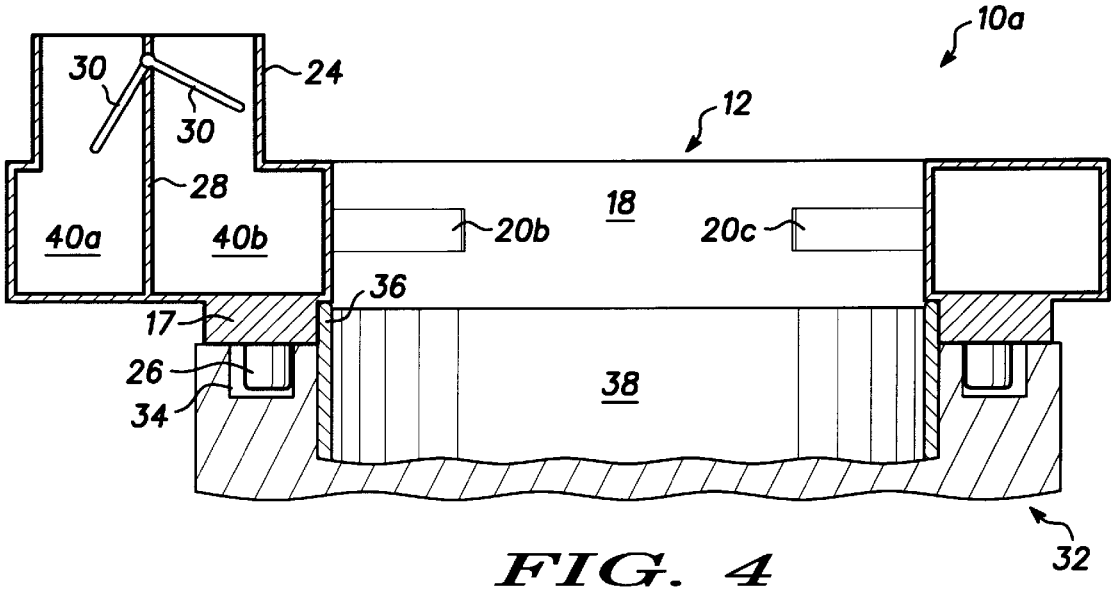
FIG. 4 is a vertical cross-sectional view taken through the ventilation fixture of FIG. 1 when affixed to a plasma etch tool.

FIGS. 1–4 show a local exhaust ventilation fixture 10*a* (hereinafter "ventilation fixture") in accordance with an embodiment of the present invention. Ventilation fixture 10*a* is employed to remove odorous fumes and byproducts from the processing chamber 38 of a plasma etch tool 32 (hereinafter "tool"), as shown in FIG. 4.

Ventilation fixture 10*a* includes a manifold 12 with an internal cavity bounded by an upper member 14, a lower member 15, an outer member 16, and an inner member 18. Manifold 12 has an overall C-shaped configuration, thus including a central circular opening 19, partially bounded by inner member 18. In this embodiment, inner member 18 of manifold 12 forms a central opening 19 having a cross-sectional shape similar to that of the processing chamber 38.

Integrally connected to manifold 12 is a base portion 17, which has a general C-shaped configuration and extends away from lower member 15. Upper member 14 is flat, and parallel with various surfaces of lower member 15 and base portion 17. The outer 16 and inner 18 members are generally round.

Four anchoring posts 26 protrude from base portion 17. Referring to FIG. 4, each anchoring post 26 fits within an anchoring recess 34 set within a surface portion of tool 32. By way of example, tool 32 is a Lam Research plasma etch tool of the 4500, 4620, or 9600 series, each series having an anchoring recess 34 at the four corners of a parallelogram-shaped footprint. The anchoring post footprint extending from base portion 17 matches the tool's anchoring recess footprint to facilitate securing ventilation fixture 10*a* to tool 32. Moreover, base portion 17 does not form part of the manifold's internal cavity, but could, if so desired.

The inner circumferential surface of base portion 17, together with a portion of lower member 15, form a sealing notch 22 located adjacent and below inner member 18. Sealing notch 22 receives a lip 36, which bounds and extends up from the processing chamber 38 of tool 32, as shown in FIG. 4. A snug fit in between sealing notch 22 and lip 36 is desirable to prevent drawing air therebetween. Thus, when ventilation fixture 10*a* is secured atop tool 32 for use, the anchoring posts 26 fit within the tool's anchoring recesses 34, and the tool's lip 36 fits snugly within sealing notch 22.

Upper member 14 includes an opening to accommodate a quick disconnect fitting 24, which is integrally connected with manifold 12. A separator vane 28 extends up from the interior of manifold 12, and through quick disconnect fitting 24. When ventilation fixture 10*a* is in use, a vacuum source line is conveniently coupled to quick disconnect fitting 24. Quick disconnect fitting 24 is preferably located near one of the ends of the C-shaped manifold 12. This placement optimizes the technician's visual and physical access to the processing chamber 38, particularly when tool 32 is a Lam Research plasma etch tool of the 4500, 4620, or 9600 series.

Inner member 18 includes four intake apertures 20*a–d,* each resembling a slot having a generally rectangular shape. With ventilation fixture 10*a* installed on tool 32, intake apertures 20*a–d* are positioned around the perimeter of and slightly above processing chamber 38. Moreover, intake apertures 20*a* and 20*b* are located opposite intake apertures 20*c* and 20*d,* such that air is drawn from opposing sides of the processing chamber 38.

In this embodiment, four intake apertures 20*a–d* are used. It should be noted that the number of intake apertures is not a limitation of the present invention. That is, a different number of intake apertures could be employed. For example, ventilation fixture can include more than four intake apertures or less than four intake apertures. The rectangular-shaped intake apertures 20*a–d* have a width-to-length ratio of less than 0.2. However, a larger ratio could be employed. In addition, various other shapes could be employed for intake apertures 20*a–d,* if desired.

The cross-sectional view of FIG. 3 shows that the interior cavity of manifold 12 is subdivided by separator vane 28 into two cavities 40*a* and 40*b*. Recalling that separator vane 28 extends through quick disconnect fitting 24, vacuum through one chamber of quick disconnect fitting 24 is supplied to cavity 40*a,* and thereby to intake apertures 20*c* and 20*d*. In other words, cavity 40*a* is in fluid communication with quick disconnect fitting 24 and with intake apertures 20*c* and 20*d*. Vacuum through the other chamber of quick disconnect fitting 24 is supplied to cavity 40*b,* and intake apertures 20*a* and 20*b*. Use of separator vane 28 balances vacuum supplied to the intake apertures 20*a–d,* thus desirably providing even capture across the processing chamber 38.

Referring to FIG. 4, a pair of dampers 30 are depicted, one per chamber on either side of separator vane 28 within quick disconnect fitting 24. Keeping in mind the desire to have even capture across the processing chamber 38, dampers 30 are adjustable to control vacuum supplied to the various intake apertures 20*a–d*. It should be noted that any conventional flow constricting device, such as a damper, baffle, or the like may be employed to control the vacuum supplied to intake apertures 20*a–d*.

Figure 5:
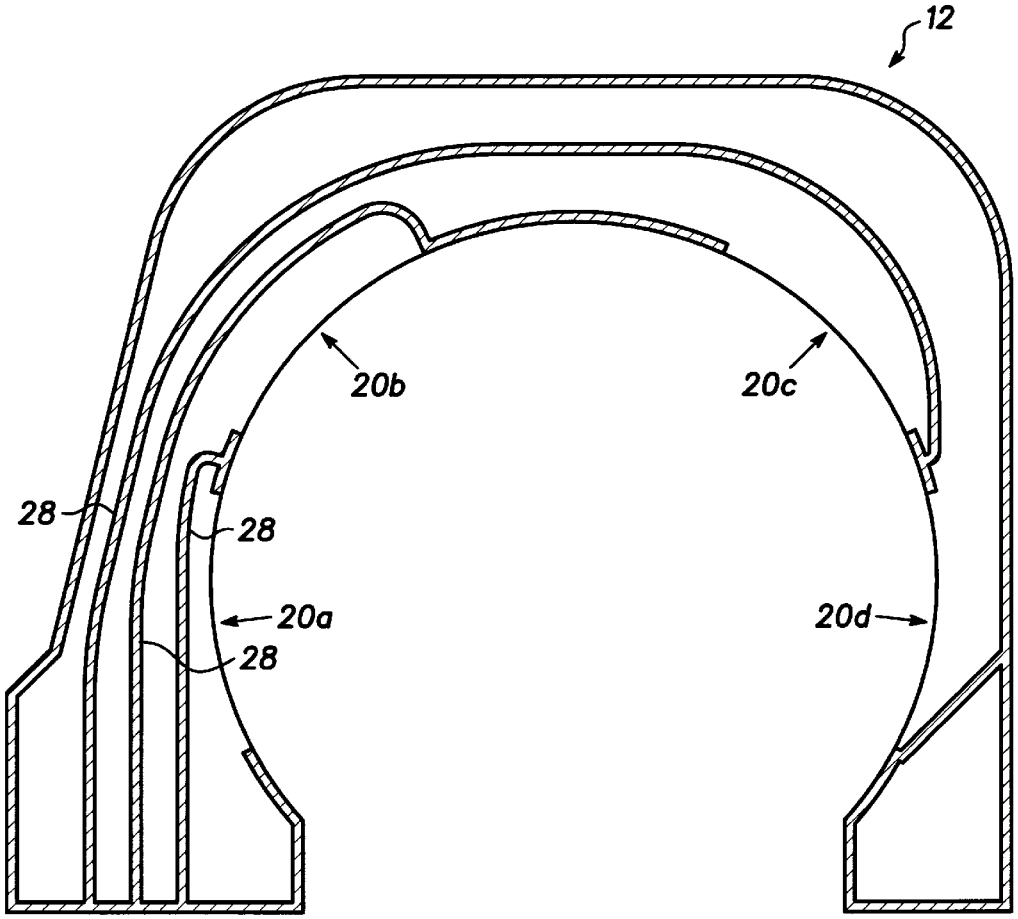
FIG. 5 is a horizontal cross-sectional view taken through the multi-separator-vane variation of the ventilation fixture of FIG. 1.

FIG. 5 depicts a variation of the ventilation fixture 10*a* shown in FIGS. 1–4. Specifically, rather than using a single separator vane 28, as shown in FIGS. 1–4, a plurality of separator vanes 28 are employed in the embodiment shown in FIG. 5 such that each intake aperture 20*a–d* has an independent vacuum supply path.

Figure 6:
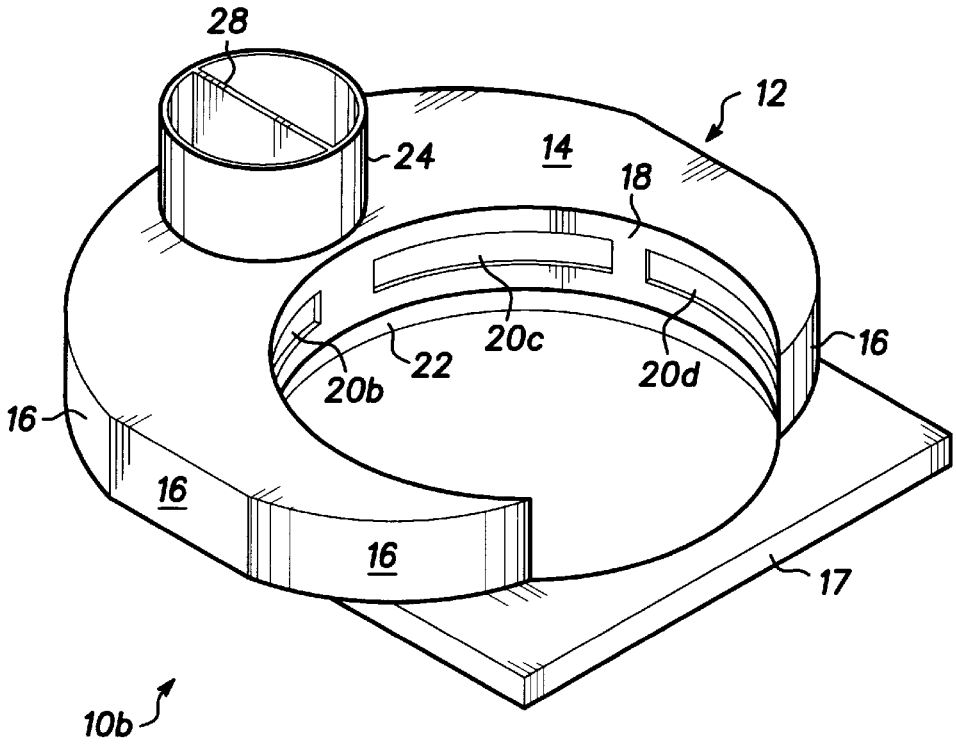
FIG. 6 is an upper perspective view of a ventilation fixture in accordance with a second embodiment of the present invention.
Figure 7:
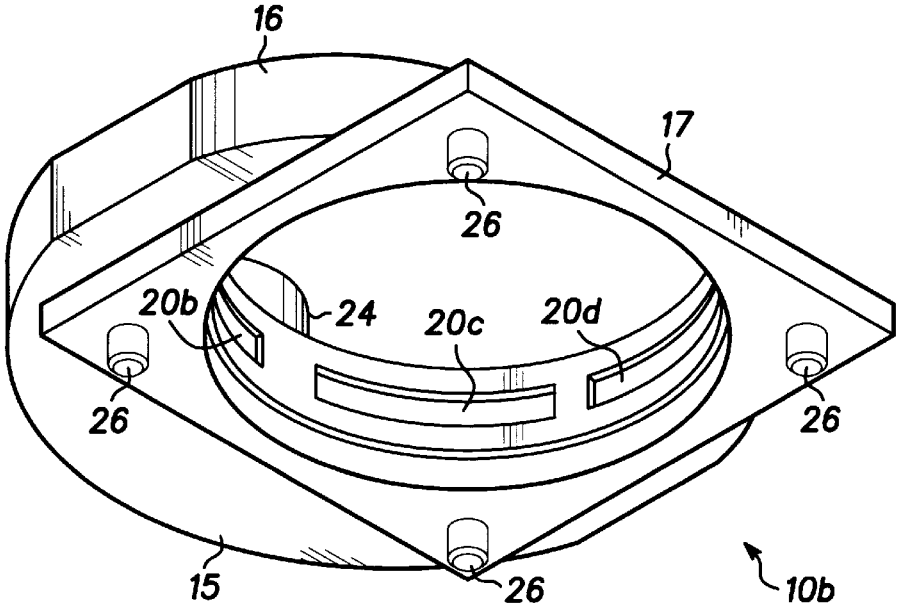
FIG. 7 is a lower perspective view of the ventilation fixture of FIG. 6.
Figure 8:
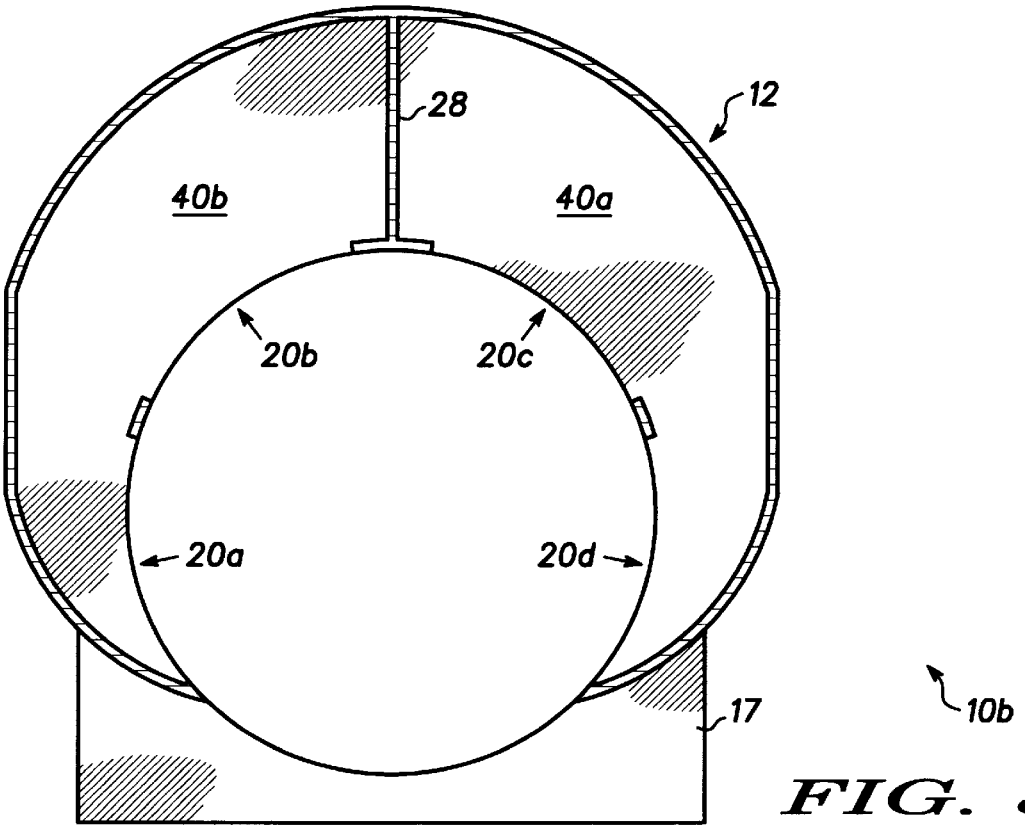
FIG. 8 is a horizontal cross-sectional view taken through the ventilation fixture of FIG. 6.

FIGS. 6–8 show another embodiment of a ventilation fixture 10*b,* originally conceived to remove odorous fumes and byproducts during cleaning of the processing chamber 38 of a Lam Research series 490 or 590 plasma etch tool 32. This particular series of tools 32 is not shown, though the reference numbers employed for descriptive purposes here are the same as in the prior tool's description, as the tools share certain features.

Similar to ventilation fixture 10*a,* ventilation fixture 10*b* includes a manifold 12 with an internal cavity bounded by an upper member 14, a lower member 15, an outer member 16, and an inner member 18. Manifold 12 has an overall C-shaped configuration, thus including a central circular opening, partially bounded by inner member 18. Integrally connected to manifold 12 is a base portion 17, which has a parallelogram-shaped configuration and protrudes away from lower member 15. Upper member 14 is flat, and parallel with various surfaces of lower member 15 and base portion 17. The outer 16 and inner 18 members are generally round.

As before, four anchoring posts 26 protrude from base portion 17 in a footprint matching an anchoring recess footprint in tool 32. Base portion 17 does not form part of the manifold's internal cavity, but could, if so desired. Also, the inner circumferential surface of base portion 17, together with a portion of lower member 15, form sealing notch 22 located adjacent and below inner member 18. Sealing notch 22 receives lip 36 of tool 32 to create a snug fit therebetween. Thus as before, when ventilation fixture 10*b* is fit for use with tool 32, anchoring posts 26 fit within the tool's anchoring recesses 34, and the tool's lip 36 fits snugly within sealing notch 22.

Once again, upper member 14 includes an opening to accommodate quick disconnect fitting 24, which is integrally connected with manifold 12. Separator vane 28 extends up from the interior of manifold 12, and through quick disconnect fitting 24. When ventilation fixture 10*b* is in use, a vacuum source line is conveniently coupled to quick disconnect fitting 24. Quick disconnect fitting 24 is located between the ends of C-shaped manifold 12, preferably at a midpoint. This placement optimizes the technician's visual and physical access to processing chamber 38, particularly when tool 32 is a Lam Research plasma etch tool of the 490 or 590 series.

The number, shape, relative positioning, and width-to-length ratio of intake apertures 20*a–d* are preferably as described for use with ventilation fixture 10*a,* and as before, variations in these characteristics are permissible.

The cross-sectional view of FIG. 8 shows that the interior cavity of manifold 12 is divided by separator vane 28 into two cavities 40*a* and 40*b*. Vacuum through one chamber of quick disconnect fitting 24 is supplied to cavity 40*a,* and thereby to intake apertures 20*c* and 20*d*. Vacuum through the other chamber of quick disconnect fitting 24 is supplied to cavity 40*b,* and intake apertures 20*a* and 20*b*. Use of separator vane 28 balances vacuum supplied to intake apertures 20*a–d,* thus desirably providing even capture across the processing chamber 38.

Figure 9:
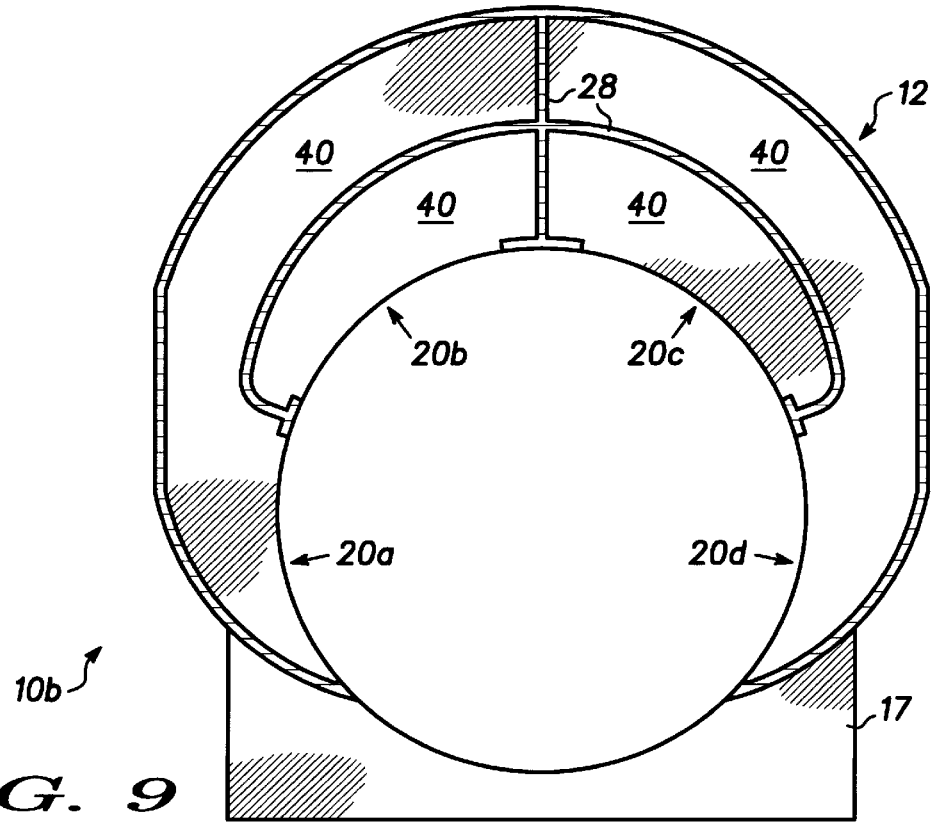
FIG. 9 is a horizontal cross-sectional view taken through the multi-separator-vane variation of the ventilation fixture of FIG. 6.

FIG. 9 depicts a variation of ventilation fixture 10*b* employing a plurality of separator vanes 28 such that each intake aperture 20*a–d* has an independent vacuum supply path. It should be noted that any conventional flow constricting device, such as a damper, baffle, or the like may be employed to provide even capture across processing chamber 38.

To use either ventilation fixture 10*a* or 10*b,* anchoring posts 26 are inserted into a tool's respective anchoring recesses 34, taking care to insert processing chamber lip 36 into abutting relation with sealing notch 22. A vacuum source line is connected to quick disconnect fitting 24, and one or more vacuum isolation valves are opened to supply vacuum. The technician commences cleaning processing chamber 38, and the evolution of gases therefrom is thereby captured by vacuum at the various intake apertures 20*a–d*. When cleaning and off-gassing is complete, vacuum is terminated, and the ventilation fixture 10*a* or 10*b* is easily removed for use on the next tool 32 needing cleaning.

Importantly, the intake slots 20*a–d* are positioned so as to not have gases being drawn directly toward an optimum working location for the technician. For ventilation fixture 10*a,* the optimum working location is facing the opening in base portion 17, while for ventilation fixture 10*b,* the optimum working location is opposite quick disconnect fitting 24.

Ventilation fixtures 10*a* and 10*b* are made using conventional materials and techniques, though preferably they are made using a lightweight sturdy material, such as fire resistant polypropylene plastic. The use of lightweight material adds to the ease with which ventilation fixtures 10*a* and 10*b* are moved from one tool 32 to the next.

The foregoing description of the preferred embodiment is merely exemplary. Modifications could be made to ventilation fixtures 10*a* and 10*b* to remove off-gassing produced during cleaning of a processing chamber 38, in any wafer fabrication tool that has a processing chamber 38 which operates under vacuum.

In the foregoing detailed description of the drawings, reference is made to the accompanying drawings which form a part hereof, and in which are shown by way of illustration specific embodiments in which the invention can be practiced. These embodiments have been described in sufficient detail to enable those skilled in the art to practice the invention, and it is to be understood that other embodiments can be utilized and that logical, mechanical changes can be made without departing from the spirit and scope of the present invention. The foregoing detailed description is, therefore, not to be taken in a limiting sense, and the scope of the present invention is defined only by the appended claims.

What is claimed is:

1. A method of cleaning a plasma etch chamber comprising the steps of:

(a) purging the chamber by introducing a gas therein and drawing the gas out of the chamber via a vacuum line;

(b) after step (a) opening the chamber and fitting about an open chamber lip a manifold having an internal cavity providing a fluid communication between a quick disconnect fitting and at least one intake aperture located adjacent to the open chamber lip, the manifold when fit to the chamber lip providing access to an inner chamber surface; and (c) attaching the quick disconnect fitting to the vacuum line; and (d) after step (c) wiping the inner chamber surface with a cleaning agent while drawing released gasses into the manifold.

2. The method of claim 1 wherein the manifold forms a central opening having a cross-sectional shape similar to that of the processing chamber.

3. The method of claim 2 wherein the cross-sectional shape is circular.

4. The method of claim 1 wherein the manifold has a C-shaped cross-section.

5. The method of claim 1 wherein the processing chamber includes a lip protruding therefrom which forms a seal with the ventilation fixture, when the manifold is affixed for cleaning the processing chamber.

6. The method of claim 1 wherein the manifold fits around the processing chamber, when the manifold is affixed for cleaning the processing chamber.

7. The method of claim 1 wherein the manifold includes a plurality of intake apertures situated around the processing chamber, when the manifold is affixed for cleaning the processing chamber.

8. The method of claim 7 further including a separator vane within the manifold which subdivides the internal cavity into a plurality of cavities, each in fluid communication with a plurality of intake apertures.

9. The method of claim 8 wherein the manifold includes four intake apertures.

10. The method of claim 8 wherein the intake apertures are rectangular.

11. The method of claim 1 wherein the width-to-length ratio for the rectangular-shaped intake apertures is less than 0.2.

12. The method of claim 8 wherein the intake apertures are positioned to avoid drawing gases produced during cleaning of the processing chamber toward an optimum working location for a technician.

13. The method of claim 8 wherein the intake apertures are positioned to draw gases produced during cleaning from opposing sides of the processing chamber.

14. The method of claim 7 further including a plurality of separator vanes within the manifold which subdivide the internal cavity into a plurality of cavities, each in fluid communication with an intake aperture.

15. The method of claim 8 wherein equal vacuum is supplied to each intake aperture.

16. The method of claim 8 further including a flow constricting device between the source of vacuum and an intake aperture.

17. The method of claim 1 further including a shoe protruding from the manifold and including a plurality of posts for anchoring the ventilation fixture adjacent to the processing chamber.

* * * * *